US012687300B1

(12) United States Patent
Bao

(10) Patent No.: US 12,687,300 B1
(45) Date of Patent: Jul. 21, 2026

(54) PORTABLE FIRE-STARTING DEVICE

(71) Applicant: Piyong Bao, Guan County (CN)

(72) Inventor: Piyong Bao, Guan County (CN)

(73) Assignee: Piyong Bao, Guan County (CN)

( * ) Notice: Subject to any disclaimer, the term of this patent is extended or adjusted under 35 U.S.C. 154(b) by 0 days.

(21) Appl. No.: 19/532,608

(22) Filed: Feb. 6, 2026

(51) Int. Cl.
*F24C 1/16* (2021.01)
*F24B 5/02* (2006.01)

(52) U.S. Cl.
CPC ..... *F24C 1/16* (2013.01); *F24B 5/021* (2013.01)

(58) Field of Classification Search
CPC ..... A47J 37/079
USPC ..... 126/9 R, 25 B
See application file for complete search history.

(56) References Cited

U.S. PATENT DOCUMENTS 2,843,105 A * 7/1958 Badish ..... A47J 36/30 126/25 B
5,230,325 A * 7/1993 Williams ..... A47J 37/079 126/25 B
5,284,126 A * 2/1994 Varney ..... F24C 1/06 126/29
2015/0276228 A1 10/2015 Marcakis
2018/0119042 A1 5/2018 Molburg
2019/0045974 A1 2/2019 Villareal Vives et al.

* cited by examiner

*Primary Examiner* — Vivek K Shirsat

(57) ABSTRACT

Disclosed is a portable fire-starting device, including at least two inner housing plates, at least two outer housing plates, and a connection assembly. The inner housing plates are provided with ventilation holes, and the inner housing plates enclose to form an inner housing configured to accommodate a combustible material. One of the outer housing plates is provided with an air inlet hole, and the outer housing plates enclose to form an outer housing. The outer housing is disposed surrounding the inner housing. The connection assembly is connected to each of the inner housing plates and each of the outer housing plates, so that an air flow channel is formed between the inner housing and the outer housing. The air flow channel is communicated with the ventilation holes and the air inlet hole.

9 Claims, 7 Drawing Sheets

PORTABLE FIRE-STARTING DEVICE

TECHNICAL FIELD

The present disclosure relates to the technical field of fire-starting devices, and in particular, to a portable fire-starting device.

BACKGROUND

Wild camping is an outdoor lifestyle that takes the natural environment as an activity field. It usually requires setting up a temporary campsite. Moreover, for heating, cooking, and safe drinking water, outdoor campers inevitably need to make a fire. In order to better ignite fuels such as branches and leaves, most outdoor campers carry fire-starting devices.

Currently, most existing fire-starting devices such as stoves on the market are integrated. Their volume and weight are reduced to allow single-person carrying, but the capacity of such fire-starting devices is small, resulting in poor heating and cooking effects. On the other hand, larger-volume fire-starting devices are difficult to carry, severely occupying storage space for other necessary survival supplies, causing many troubles for outdoor campers.

For this purpose, the present disclosure provides a portable fire-starting device, which may effectively solve the above problems. It is convenient to assemble and easy to carry.

SUMMARY

In order to overcome the deficiencies of the prior art, the present disclosure provides a portable fire-starting device, which is convenient to assemble and easy to carry.

The technical solution adopted by the present disclosure to solve the technical problems is as follows.

A portable fire-starting device includes:

at least two inner housing plates, the inner housing plates being provided with ventilation holes, all inner housing plates enclosing to form an inner housing configured to accommodate a combustible material;

at least two outer housing plates, one of the outer housing plates being provided with an air inlet hole, all outer housing plates enclosing to form an outer housing, the outer housing being disposed surrounding the inner housing;

a connection assembly, the connection assembly being connected to each of the inner housing plates and each of the outer housing plates, so that an air flow channel is formed between the inner housing and the outer housing, the air flow channel being communicated with the ventilation holes and the air inlet hole.

In some implementations, the connection assembly includes a connection plate and at least two fixing members, the connection plate is connected to each of the inner housing plates and each of the outer housing plates, the connection plate is abutted against an outer wall of the inner housing plate and an inner wall of the outer housing plate, and the fixing members are clamped between an inner wall of the inner housing plate and an outer wall of the outer housing plate.

In some implementations, the connection plate is provided with a first connection portion and a second connection portion, the inner housing plate is provided with a first insertion slot, the outer housing plate is provided with a second insertion slot, the first connection portion is inserted into the first insertion slot, and the second connection portion is inserted into the second insertion slot.

In some implementations, the fixing member is provided with a hand-held portion and two oppositely disposed outer clamping portions, the two outer clamping portions are extended downward from lower surfaces at two ends of the hand-held portion, inner surfaces of the two outer clamping portions are respectively abutted against the inner wall of the inner housing plate and the outer wall of the outer housing plate, and a distance D1 between the inner wall of the inner housing plate and the outer wall of the outer housing plate is approximately equal to a distance D2 between the two inner surfaces of the two outer clamping portions.

In some implementations, the fixing member is further provided with a middle clamping portion, the middle clamping portion is located between the two outer clamping portions, and two outer surfaces of the middle clamping portion are respectively abutted against the outer wall of the inner housing plate and the inner wall of the outer housing plate.

In some implementations, the first connection portion is provided with a first insertion hole, the second connection portion is provided with a second insertion hole, and lower ends of the two outer clamping portions are respectively inserted into the first insertion hole and the second insertion hole.

In some implementations, outer sides of the two outer clamping portions are each provided with a guiding inclined surface, and widths of the two outer clamping portions gradually narrow from top to bottom along a direction perpendicular to outer surfaces of the at least two outer housing plates.

In some implementations, the hand-held portion is provided with a through-hole.

In some implementations, an end of the hand-held portion, distal to the outer clamping portions, of at least part of the fixing members, is gradually extended in a direction distal to a center of the inner housing.

In some implementations, a portion of the fixing members is connected to an upper edge of the inner housing plate and an upper edge of the outer housing plate; and the remaining portion of the fixing members is connected to a lower edge of the inner housing plate and a lower edge of the outer housing plate.

In some implementations, further including a support plate, where an upper surface of the outer clamping portion on the fixing member connected to the lower edge of the outer housing plate forms a support plane P, and the support plate is inserted into the inner housing and is abutted against the support plane P.

The beneficial effects of the present disclosure are as follows. Through the arrangement of the above structure, when assembling the product, the connection assembly is configured to connect the inner housing plates and the outer housing plates. Furthermore, the inner housing plates are sequentially connected to form the inner housing, and the outer housing plates are sequentially connected to form the outer housing. An air flow channel is formed between the inner housing and the outer housing. When using the product, fuels such as branches and dry leaves are placed in the inner housing and ignited. The air outlet of an air pump is aligned with the air inlet hole, allowing airflow to flow through the air flow channel and the ventilation holes into the inner housing, causing fuels like branches and dry leaves in the inner housing to fully combust, thereby improving the product's usage effectiveness. When storing the product, the connection assembly is disassembled to separate the inner housing plates and the outer housing plates. The inner housing plates and the outer housing plates can be stacked and placed, effectively reducing the storage volume of the product, which is convenient for users to store and carry the product. The number of inner housing plates is the same as the number of outer housing plates, which may be two, three, four, or more. The inner housing plates collectively enclose to form the inner housing, and the outer housing plates collectively enclose to form the outer housing.

BRIEF DESCRIPTION OF THE DRAWINGS

In order to illustrate the technical solutions of the embodiments of the present disclosure more clearly, the following drawings are briefly described as required in the context of the embodiments. The following drawings illustrate only some of the embodiments of the present disclosure. Other relevant drawings may be obtained on the basis of these drawings without any creative effort by those skilled in the art.

The present disclosure is further described below in conjunction with the accompanying drawings and embodiments.

DETAILED DESCRIPTION

Figure 1:
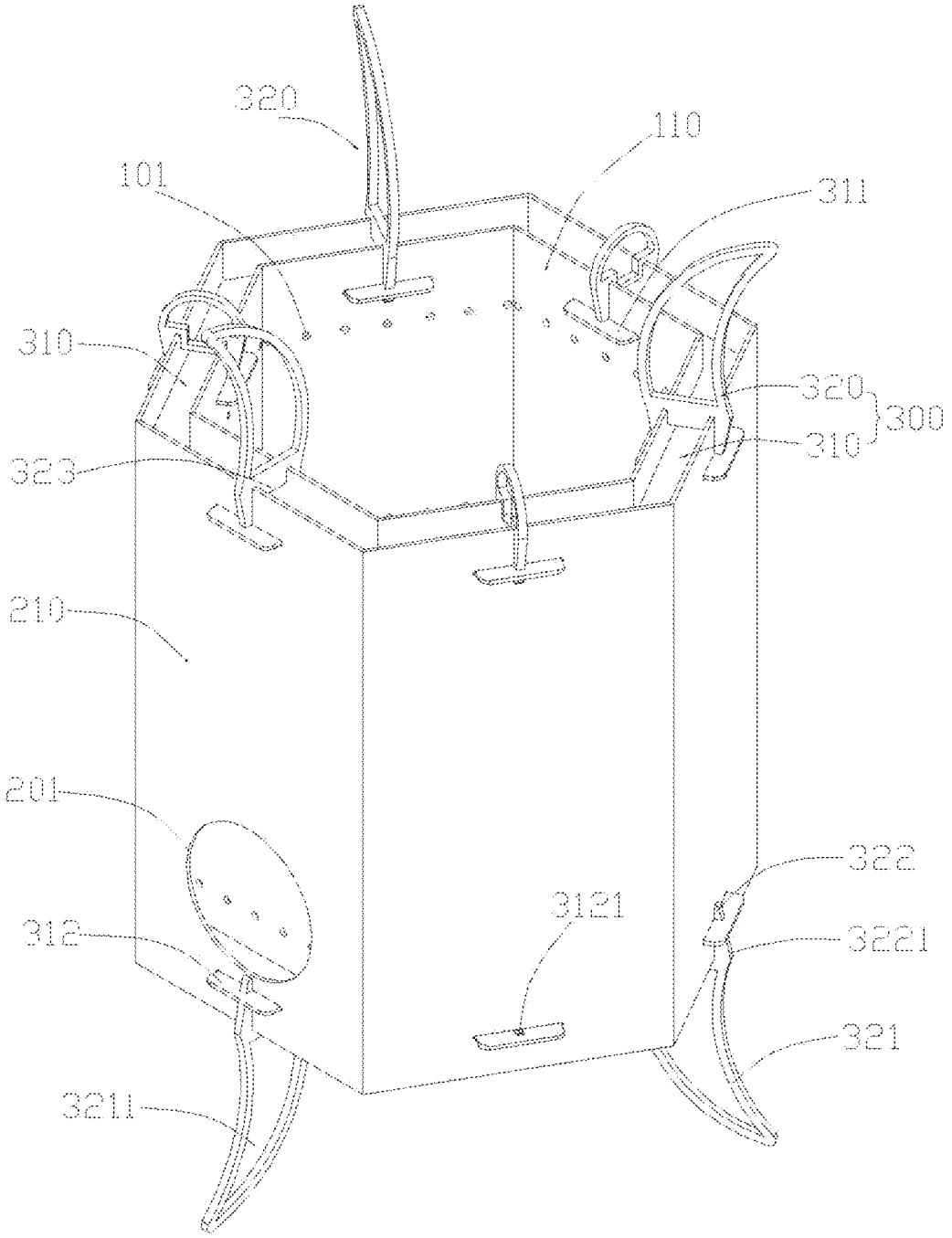
FIG. 1 is a schematic diagram of the overall structure of the fire-starting device of the present disclosure from one perspective.

In order to make the above objectives, features, and advantages of the present disclosure more clearly understandable, detailed descriptions of specific embodiments of the present disclosure are provided below in conjunction with the accompanying drawings. In the following description, numerous specific details are set forth to facilitate a full understanding of the present disclosure. However, the present disclosure may be implemented in many other ways different from those described herein, and those skilled in the art can make similar modifications without departing from the spirit of the present disclosure. Therefore, the present disclosure is not limited by the specific embodiments disclosed below.

In the description of the present disclosure, it should be understood that terms such as "center", "longitudinal", "lateral", "length", "width", "thickness", "upper", "lower", "front", "rear", "left", "right", "vertical", "horizontal", "top", "bottom", "inner", "outer", "clockwise", "counterclockwise", "axial", "radial", "circumferential", etc., are used to indicate orientation or positional relationships based on the orientation or positional relationships shown in the accompanying drawings. These terms are used merely for the convenience of describing the present disclosure and simplifying the description, and do not indicate or imply that the referred device or element must have a specific orientation or be constructed and operated in a specific orientation. Therefore, these terms should not be construed as limiting the present disclosure.

Furthermore, terms such as "first" and "second" are used for descriptive purposes only and should not be construed as indicating or implying relative importance or implicitly specifying the quantity of the indicated technical features. Thus, features defined by "first" or "second" may explicitly or implicitly include at least one such feature. In the description of the present disclosure, the term "a plurality of" means at least two, such as two, three, etc., unless otherwise explicitly and specifically defined.

In the present disclosure, unless otherwise explicitly specified and defined, terms such as "mounted", "connected", "coupled", and "fixed" should be understood broadly. For example, it may be a fixed connection, a detachable connection, or an integral connection; it may be a mechanical connection or an electrical connection; it may be a direct connection, an indirect connection through an intermediate medium, or an internal communication between two elements or an interaction relationship between two elements, unless otherwise explicitly defined. For those of ordinary skill in the art, the specific meanings of the above terms in the present disclosure may be understood according to specific circumstances.

In the present disclosure, unless otherwise explicitly specified and defined, if there are descriptions such as a first feature being "on" or "under" a second feature, these terms may mean that the first feature and the second feature are in direct contact, or that the first feature and the second feature are in indirect contact through an intermediate medium. Moreover, a first feature being "above", "over", or "on" a second feature may mean that the first feature is directly above or obliquely above the second feature, or may merely indicate that the horizontal height of the first feature is higher than that of the second feature. A first feature being "below", "under", or "beneath" a second feature may mean that the first feature is directly below or obliquely below the second feature, or may merely indicate that the horizontal height of the first feature is lower than that of the second feature.

It should be noted that if an element is referred to as being "fixed to" or "disposed on" another element, it may be directly on the other element or intervening elements may be present. If an element is considered to be "connected" to another element, it may be directly connected to the other element or intervening elements may be present simultaneously. If they exist, terms such as "vertical", "horizontal", "upper", "lower", "left", "right", and similar expressions used in the present disclosure are for illustrative purposes only and do not indicate the sole implementation.

Figure 2:
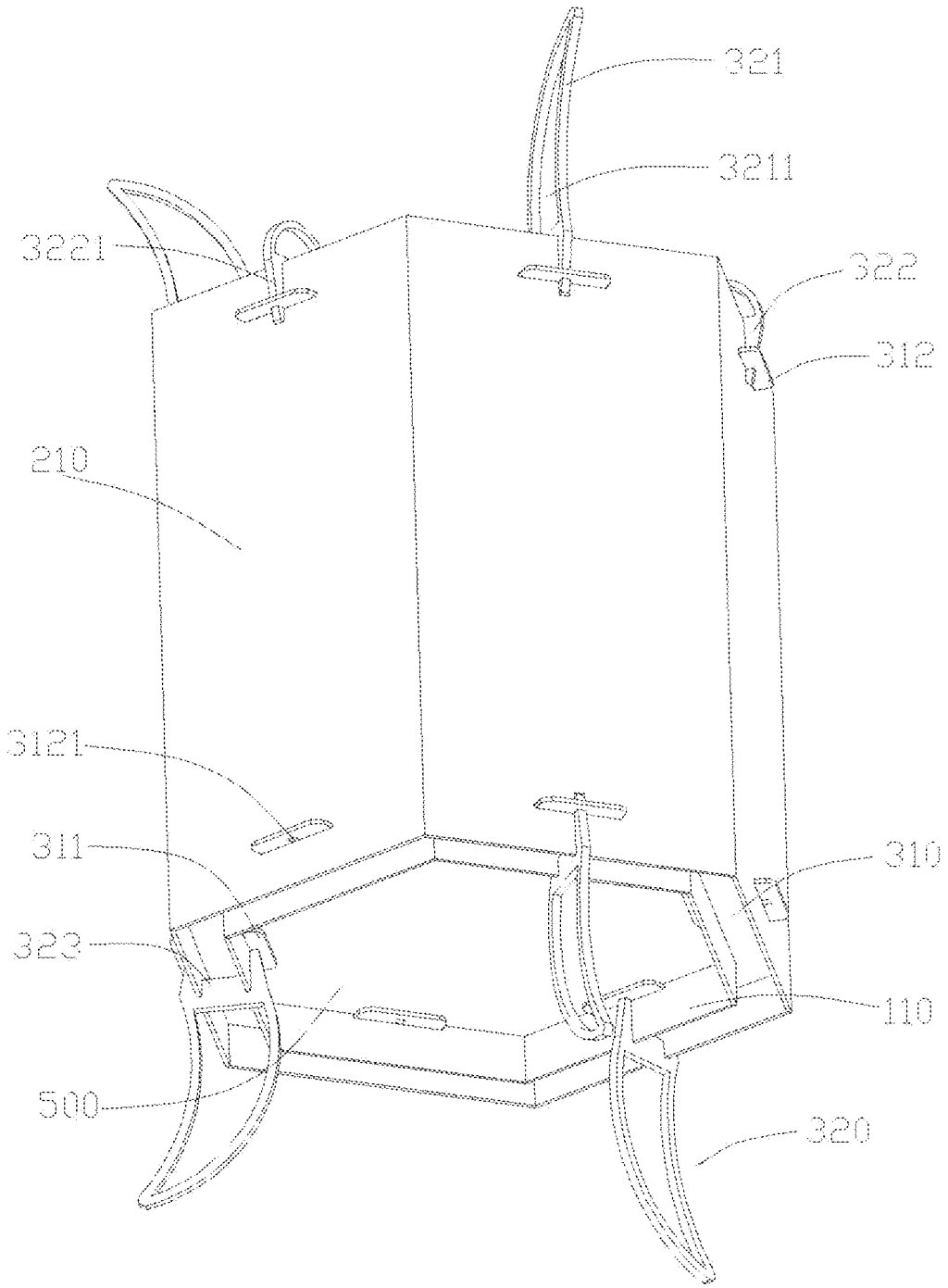
FIG. 2 is a schematic diagram of the overall structure of the fire-starting device of the present disclosure from another perspective.
Figure 3:
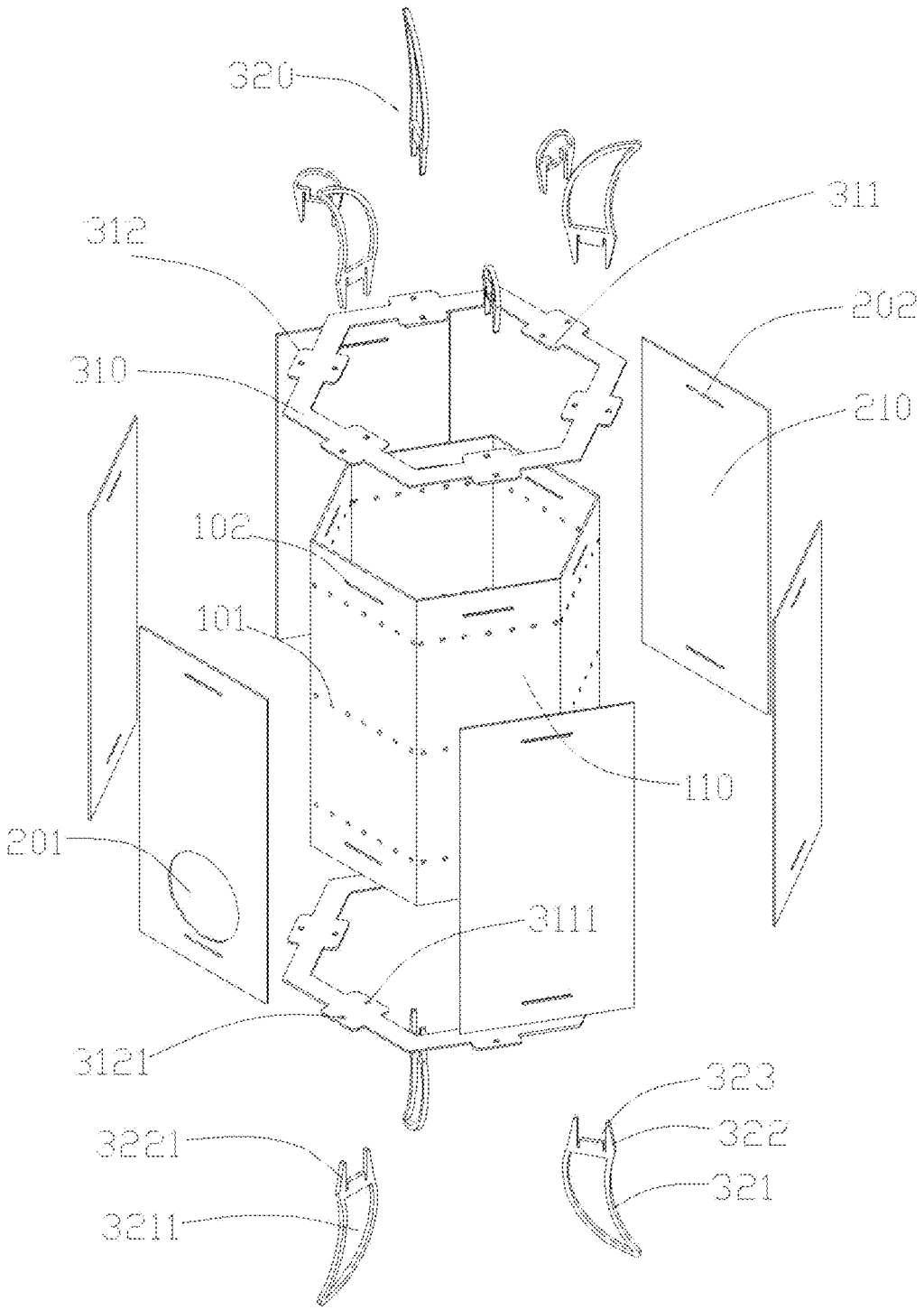
FIG. 3 is an exploded view of the structure of the fire-starting device of the present disclosure from one perspective.
Figure 4:
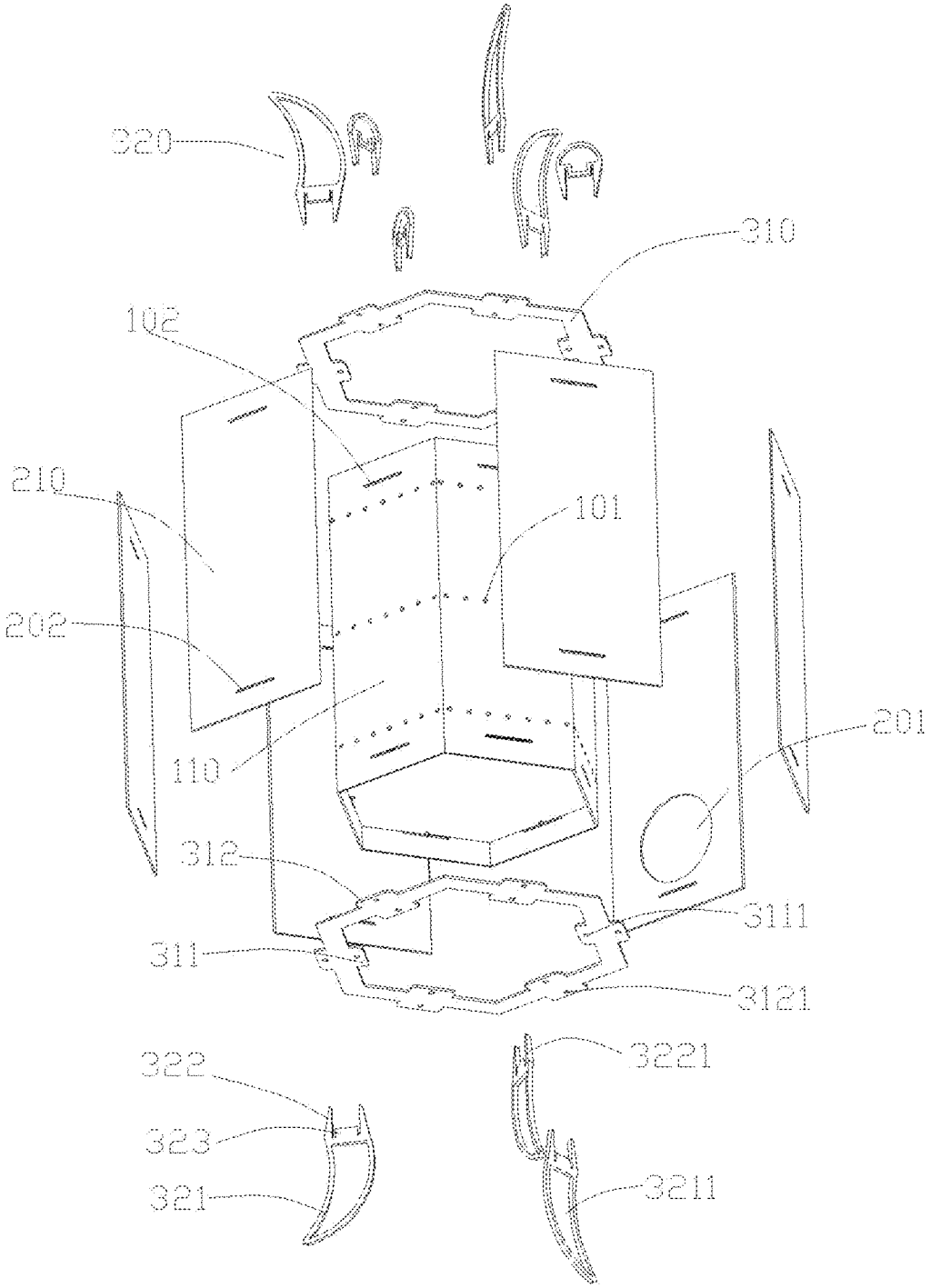
FIG. 4 is an exploded view of the structure of the fire-starting device of the present disclosure from another perspective.
Figure 5:
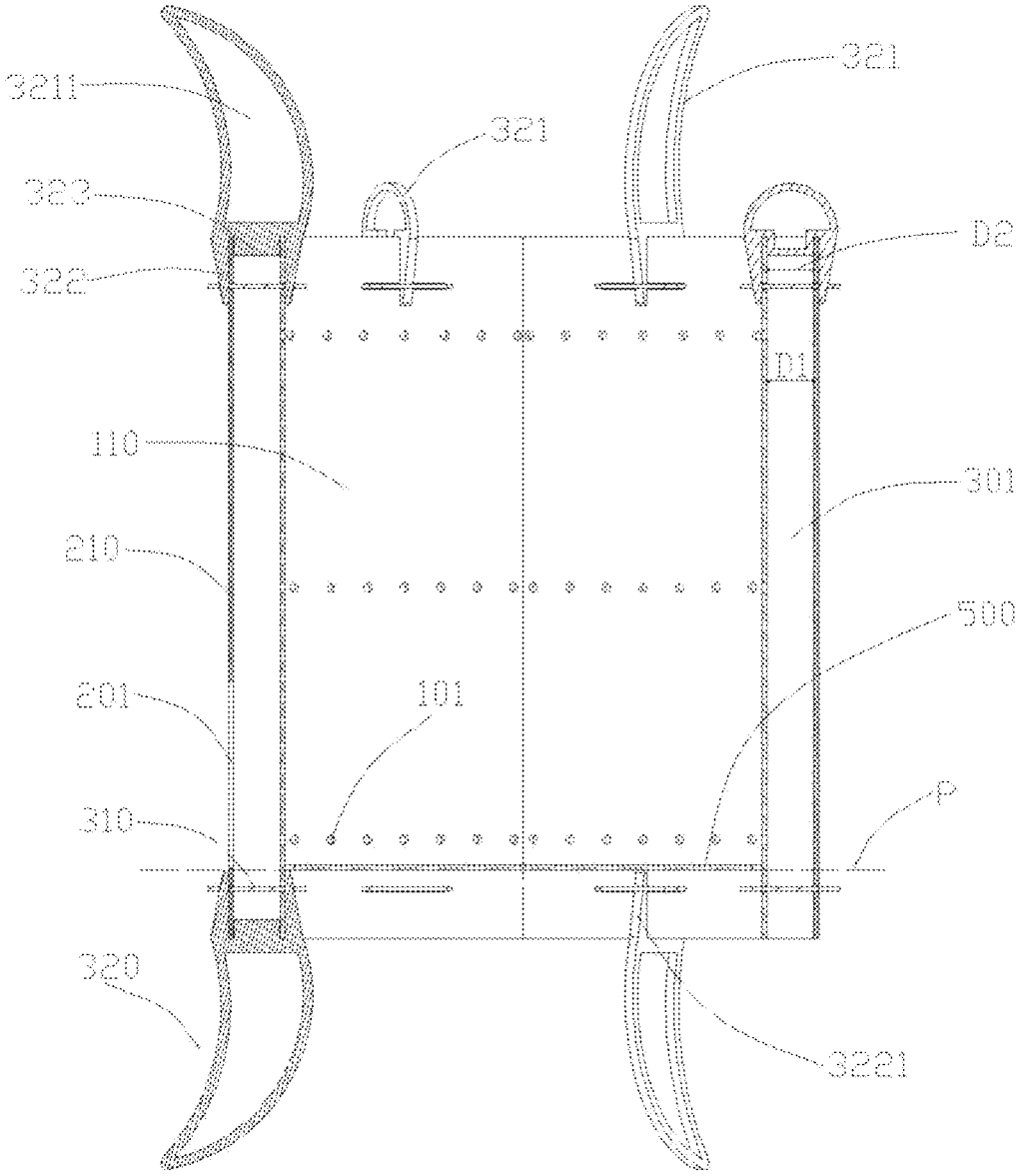
FIG. 5 is a cross-sectional schematic diagram of the structure of the fire-starting device of the present disclosure.
Figure 6:
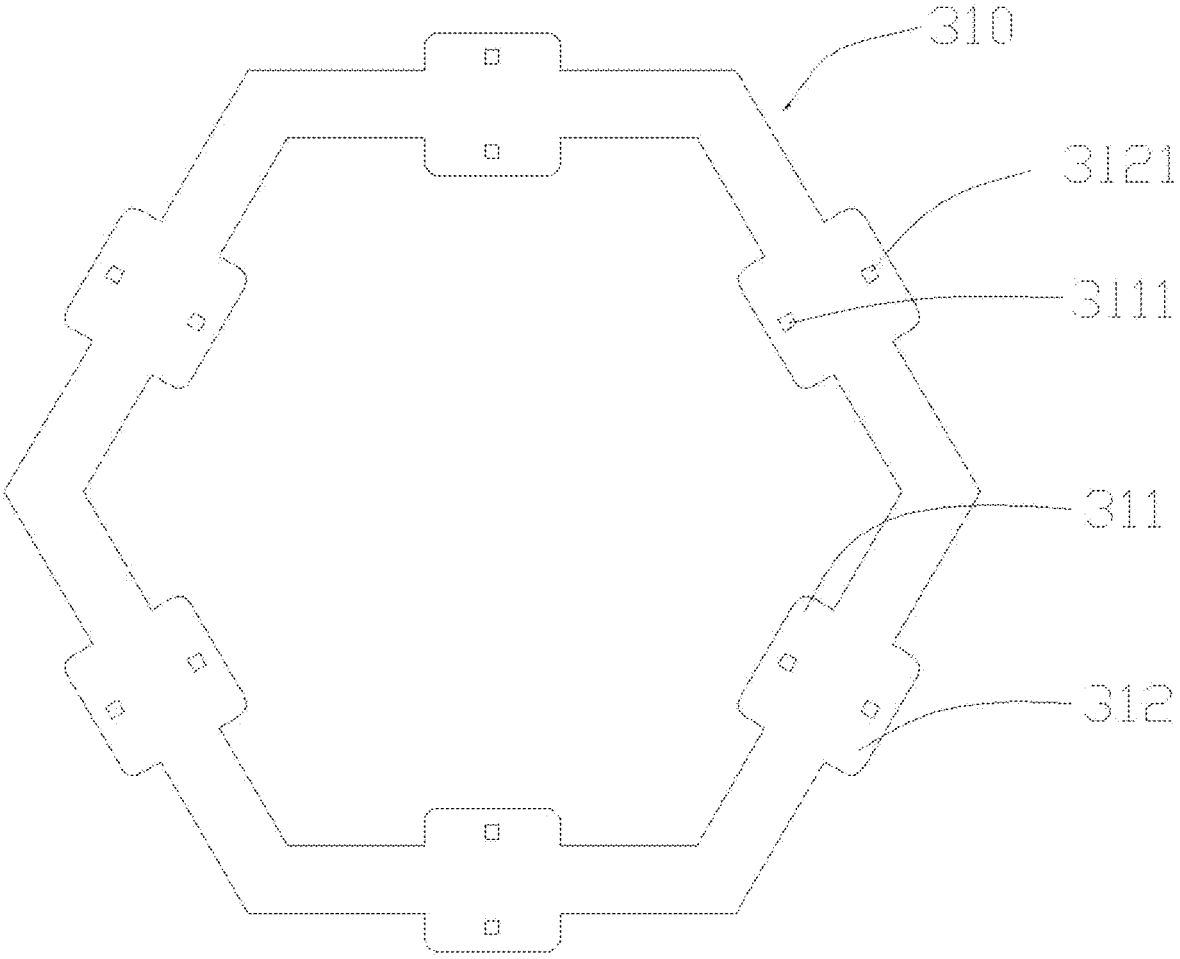
FIG. 6 is a front view of a connection plate of the fire-starting device of the present disclosure.
Figure 7:
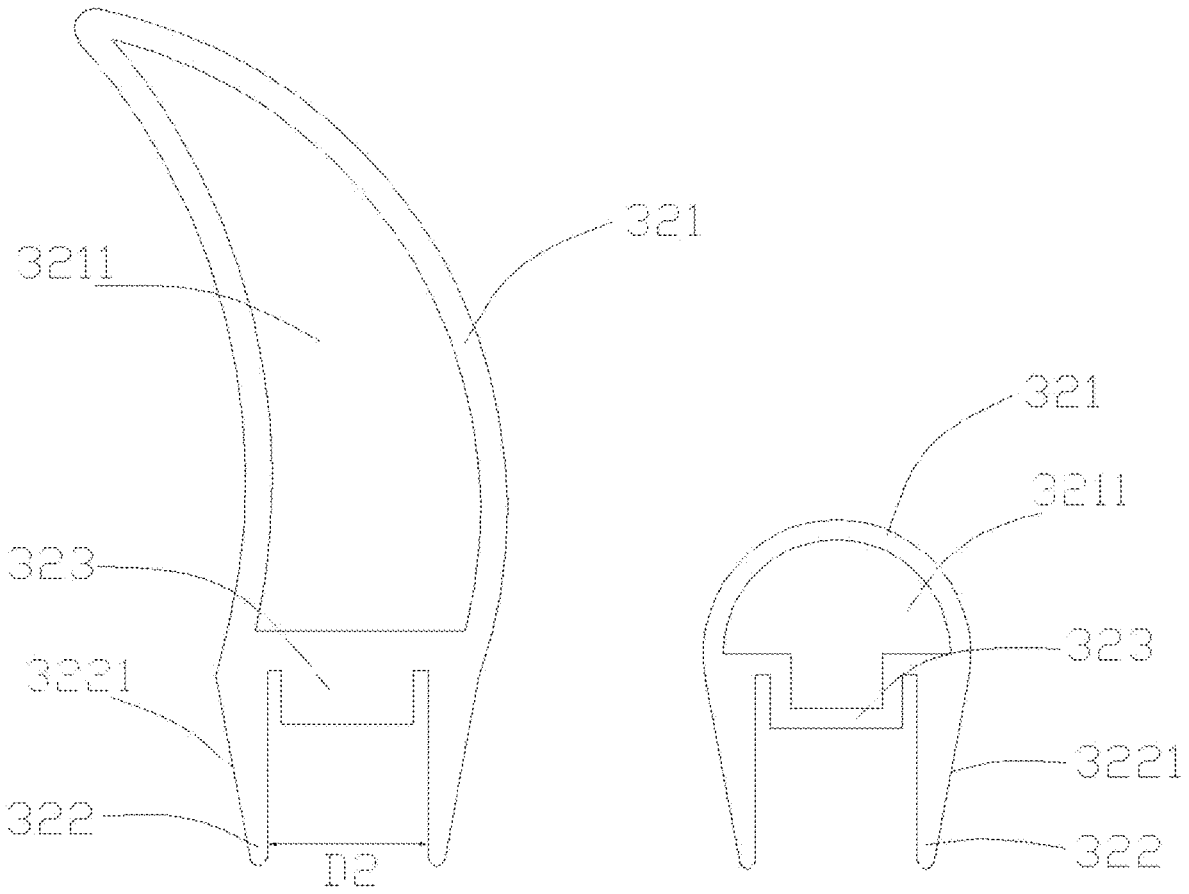
FIG. 7 is a front view of two types of fixing members of the fire-starting device of the present disclosure.

Referring to FIGS. 1 to 7, a portable fire-starting device includes:

- at least two inner housing plates 110, the inner housing plates 110 being provided with ventilation holes 101, each of the inner housing plates 110 enclosing to form an inner housing configured to accommodate a combustible material;
- at least two outer housing plates 210, one of the outer housing plates 210 being provided with an air inlet hole 201, each of the outer housing plates 210 enclosing to form an outer housing, the outer housing being disposed surrounding the inner housing;
- a connection assembly 300, the connection assembly 300 being connected to each of the inner housing plates 110 and each of the outer housing plates 210, so that an air flow channel 301 is formed between the inner housing and the outer housing, the air flow channel 301 being communicated with the ventilation holes 101 and the air inlet hole 201.

Through the arrangement of the above structure, when assembling the product, the connection assembly 300 is configured to connect the inner housing plates 110 and the outer housing plates 210. Furthermore, the inner housing plates 110 are sequentially connected to form the inner housing, and the outer housing plates 210 are sequentially connected to form the outer housing. The air flow channel 301 is formed between the inner housing and the outer housing. When using the product, fuels such as branches and dry leaves are placed in the inner housing and ignited. The air outlet of an air pump is aligned with the air inlet hole 201, allowing airflow to flow through the air flow channel 301 and the ventilation holes 101 into the inner housing, causing fuels like branches and dry leaves in the inner housing to fully combust, thereby improving the product's usage effectiveness. When storing the product, the connection assembly 300 is disassembled to separate the inner housing plates 110 and the outer housing plates 210. The inner housing plates 110 and the outer housing plates 210 can be stacked and placed, effectively reducing the storage volume of the product, which is convenient for users to store and carry the product. The number of inner housing plates 110 is the same as the number of outer housing plates 210, which may be two, three, four, or more. The inner housing plates 110 collectively enclose to form the inner housing, and the outer housing plates 210 collectively enclose to form the outer housing.

In the present embodiment, the connection assembly 300 includes a connection plate 310 and at least two fixing members 320. The connection plate 310 is connected to each of the inner housing plates 110 and each of the outer housing plates 210. The connection plate 310 abuts against an outer wall of the inner housing plate 110 and an inner wall of the outer housing plate 210. The fixing members 320 are clamped between an inner wall of the inner housing plate 110 and an outer wall of the outer housing plate 210. Through the arrangement of the above structure, the connection plate 310 is annular. When assembling the product, the outer wall of the inner housing plate 110 is abutted against an inner surface of the connection plate 310, and the inner wall of the outer housing plate 210 is abutted against an outer surface of the connection plate 310. Then, the fixing members 320 are configured to clamp between the inner wall of the inner housing plate 110 and the outer wall of the outer housing plate 210, thereby stably connecting the inner housing plate 110 and the outer housing plate 210 to the connection plate 310. Subsequently, the remaining inner housing plates 110 and outer housing plates 210 are sequentially connected to the connection plate 310, causing the inner housing plates 110 to enclose to form the inner housing and the outer housing plates 210 to enclose to form the outer housing. The air flow channel 301 is formed between the inner housing plate 110 and the outer housing plate 210.

In the present embodiment, the connection plate 310 is provided with a first connection portion 311 and a second connection portion 312. The inner housing plate 110 is provided with a first insertion slot 102. The outer housing plate 210 is provided with a second insertion slot 202. The first connection portion 311 is inserted into the first insertion slot 102, and the second connection portion 312 is inserted into the second insertion slot 202. Through the arrangement of the above structure, when assembling the product, the first connection portion 311 is inserted into the first insertion slot 102, and the second connection portion 312 is inserted into the second insertion slot 202, until the outer wall of the inner housing plate 110 abuts against the inner surface of the connection plate 310 and the inner wall of the outer housing plate 210 abuts against the outer surface of the connection plate 310. Then, the fixing members 320 are configured to clamp between the inner wall of the inner housing plate 110 and the outer wall of the outer housing plate 210, thereby stably connecting the inner housing plate 110 and the outer housing plate 210 to the connection plate 310. This installation method may effectively prevent vertical movement of the inner housing plate 110 and the outer housing plate 210. Subsequently, the remaining inner housing plates 110 and outer housing plates 210 are sequentially connected in the same manner, leading to a more stable product structure. In some implementations, the first connection portion 311 and the second connection portion 312 are both flat insertion blocks, and corners on sides thereof distal to the main body of the connection plate 310 are provided with a chamfer or a fillet. This allows users to more easily operate when inserting the first connection portion 311 into the first insertion slot 102 and/or inserting the second connection portion 312 into the second insertion slot 202, facilitating user operation.

In this embodiment, the fixing member 320 has a hand-held portion 321 and two oppositely disposed outer clamping portions 322. The two outer clamping portions 322 extend downward from lower surfaces at two ends of the hand-held portion 321. Inner surfaces of the two outer clamping portions 322 respectively abut against the inner wall of the inner housing plate 110 and the outer wall of the outer housing plate 210. A distance D1 between the inner wall of the inner housing plate 110 and the outer wall of the outer housing plate 210 is approximately equal to a distance D2 between the two inner surfaces of the two outer clamping portions 322. Through the arrangement of the above structure, when assembling the product, a user may hold the hand-held portion 321 and move the fixing member 320 towards the inner housing plate 110 and the outer housing plate 210, causing the inner surfaces of the two outer clamping portions 322 to respectively abut against the inner wall of the inner housing plate 110 and the outer wall of the outer housing plate 210. This restricts the inner housing plate 110 and the outer housing plate 210 in the radial direction, preventing them from detaching from the connection plate 310, and also leading to a more stable product structure. The distance D1 between the inner wall of the inner housing plate 110 and the outer wall of the outer housing plate 210 is approximately equal to the distance D2 between the two inner surfaces of the two outer clamping portions 322, ensuring that the inner surfaces of the two outer clamping portions 322 can stably abut against the inner wall of the inner housing plate 110 and the outer wall of the outer housing plate 210, respectively.

In the present embodiment, the fixing member 320 is further provided with an intermediate clamping portion 323. The intermediate clamping portion 323 is located between the two outer clamping portions 322. Two outer surfaces of the intermediate clamping portion 323 respectively abut against the outer wall of the inner housing plate 110 and the inner wall of the outer housing plate 210. Through the arrangement of the above structure, the intermediate clamping portion 323 is provided between the outer clamping portions 322, forming two clamping slots between the intermediate clamping portion 323 and the two outer clamping portions 322. The inner housing plate 110 and the outer housing plate 210 are respectively inserted into the two clamping slots. The two outer surfaces of the intermediate clamping portion 323 respectively abut against the outer wall of the inner housing plate 110 and the inner wall of the outer housing plate 210, enabling a more stable fixation of the inner housing plate 110 and the outer housing plate 210.

In the present embodiment, the first connection portion 311 is provided with a first insertion hole 3111, and the second connection portion 312 is provided with a second insertion hole 3121. Lower ends of the two outer clamping portions 322 are respectively inserted into the first insertion hole 3111 and the second insertion hole 3121. Through the arrangement of the above structure, when assembling the product, the lower ends of the outer clamping portions 322 are respectively inserted into the first insertion hole 3111 and the second insertion hole 3121. This may effectively restrict horizontal movement of the fixing member 320, prevent the fixing member 320 from falling off, and improve the stability of the product.

In the present embodiment, outer sides of the two outer clamping portions 322 are each provided with a guiding inclined surface 3221. Widths of the two outer clamping portions 322 gradually narrow from top to bottom along a direction perpendicular to outer surfaces of the at least two outer housing plates. Through the arrangement of the above structure, the width of the outer clamping portion 322 gradually increases from its insertion end to its connection end. The narrower insertion end allows the user to easily align the outer clamping portion 322 with the first insertion hole 3111 and the second insertion hole 3121, facilitating product assembly for the user. Furthermore, when the outer clamping portion 322 is inserted into the installation position, the outer surface of the outer clamping portion 322 precisely abuts against the inner wall of the first insertion hole 3111 or the inner wall of the second insertion hole 3121, leading to a more stable product structure.

In the present embodiment, the hand-held portion 321 is provided with a through hole 3211. By forming the through hole 3211 in the hand-held portion, the weight of the fixing member 320 may be reduced, facilitating the user to carry the product, reducing the user's load, and improving the user experience.

In the present embodiment, an end of the hand-held portion 321, distal to the outer clamping portions 322, of at least part of the fixing members 320, gradually extends in a direction distal to a center of the inner housing. Through the arrangement of the above structure, as shown by the fixing member 320 on the left side of FIG. 7, an end of the hand-held portion 321, distal to the outer clamping portions 322, gradually extends in a direction distal to the center of the inner housing, i.e., extending outward. The end thereof may be configured to abut against a placement surface such as the ground, allowing the user to place the product on the ground for convenient use. Furthermore, it may increase the height of the product, making it easier for the user to add fuel or place cookware, leading to more convenient use. Moreover, because it extends outward, the support point is distal to the center of the inner housing, the product's center of gravity is stable, making it less prone to tipping over, leading to safer use.

In the present embodiment, a portion of the fixing members 320 is connected to an upper edge of the inner housing plate 110 and an upper edge of the outer housing plate 210; the remaining portion of the fixing members 320 is connected to a lower edge of the inner housing plate 110 and a lower edge of the outer housing plate 210. Through the arrangement of the above structure, the fixing members 320 connected to the upper edge of the inner housing plate 110 and the upper edge of the outer housing plate 210, on one hand, may fix the inner housing plate 110 and the outer housing plate 210. On the other hand, they may also support cookware such as pots, enabling stable placement of the cookware. Some fixing members 320 (as shown on the left side of FIG. 7) extend outward, forming a support portion that is wider at the top and narrower at the bottom, preventing the cookware from slipping and falling off. Other fixing members 320 (as shown on the right side of FIG. 7) have a shorter, circular hand-held portion 321, facilitating the user in adding fuel such as branches from this location.

In the present embodiment, the portable fire-starting device further includes a support plate 500. An upper surface of the outer clamping portion 322 on the fixing member 320 connected to the lower edge of the outer housing plate 210 forms a support plane P. The support plate 500 is inserted into the inner housing and abuts against the support plane P. Through the arrangement of the above structure, the support plate 500 is located inside the inner housing. The upper surfaces of the various outer clamping portions 322 inside the inner housing are approximately on a common plane. A lower surface of the support plate 500 abuts against the upper surfaces of the various outer clamping portions 322, forming stable support. The support plate 500 may support fuels such as branches.

What is claimed is:

1. A portable fire-starting device, comprising:

at least two inner housing plates, the inner housing plates being provided with ventilation holes, all inner housing plates enclosing to form an inner housing configured to accommodate a combustible material;

at least two outer housing plates, one of the outer housing plates being provided with an air inlet hole, all outer housing plates enclosing to form an outer housing, the outer housing being disposed surrounding the inner housing;

a connection assembly, the connection assembly being connected to each of the inner housing plates and each of the outer housing plates, so that an air flow channel is formed between the inner housing and the outer housing, the air flow channel being communicated with the ventilation holes and the air inlet hole;

wherein the connection assembly comprises a connection plate and at least two fixing members, the connection plate is connected to each of the inner housing plates and each of the outer housing plates, the connection plate is abutted against an outer wall of the inner housing plate and an inner wall of the outer housing plate, and the fixing members are clamped between an inner wall of the inner housing plate and an outer wall of the outer housing plate.

2. The portable fire-starting device according to claim 1, wherein the connection plate is provided with a first connection portion and a second connection portion, the inner housing plate is provided with a first insertion slot, the outer housing plate is provided with a second insertion slot, the first connection portion is inserted into the first insertion slot, and the second connection portion is inserted into the second insertion slot.

3. The portable fire-starting device according to claim 1, wherein the fixing member is provided with a hand-held portion and two oppositely disposed outer clamping portions, the two outer clamping portions are extended downward from lower surfaces at two ends of the hand-held portion, inner surfaces of the two outer clamping portions are respectively abutted against the inner wall of the inner housing plate and the outer wall of the outer housing plate, and a distance between the inner wall of the inner housing plate and the outer wall of the outer housing plate is equal to a distance between the two inner surfaces of the two outer clamping portions.

4. The portable fire-starting device according to claim 3, wherein the fixing member is further provided with a middle clamping portion, the middle clamping portion is located between the two outer clamping portions, and two outer surfaces of the middle clamping portion are respectively abutted against the outer wall of the inner housing plate and the inner wall of the outer housing plate.

5. The portable fire-starting device according to claim 3, wherein the first connection portion is provided with a first insertion hole, the second connection portion is provided with a second insertion hole, and lower ends of the two outer clamping portions are respectively inserted into the first insertion hole and the second insertion hole.

6. The portable fire-starting device according to claim 5, wherein outer sides of the two outer clamping portions are each provided with a guiding inclined surface.

7. The portable fire-starting device according to claim 3, wherein an end of the hand-held portion, distal to the outer clamping portions, of at least part of the fixing members, is gradually extended in a direction distal to a center of the inner housing.

8. The portable fire-starting device according to claim 3, wherein a portion of the fixing members is connected to an upper edge of the inner housing plate and an upper edge of the outer housing plate; and the remaining portion of the fixing members is connected to a lower edge of the inner housing plate and a lower edge of the outer housing plate.

9. The portable fire-starting device according to claim 8, further comprising a support plate, wherein an upper surface of the outer clamping portion on the fixing member connected to the lower edge of the outer housing plate forms a support plane, and the support plate is inserted into the inner housing and is abutted against the support plane.

* * * * *